United States Patent [19]

Busse

[11] Patent Number: 4,485,547

[45] Date of Patent: Dec. 4, 1984

[54] APPARATUS FOR PRESSURE FITTING A TUBE IN A PLATE, E.G. A TUBE SHEET

[76] Inventor: Wilfried Busse, Harkortstrasse 8-10, 4630 Bochum, Fed. Rep. of Germany

[21] Appl. No.: 349,259

[22] Filed: Feb. 16, 1982

[30] Foreign Application Priority Data

Feb. 17, 1981 [DE] Fed. Rep. of Germany ..... 3105735

[51] Int. Cl.[3] ..... B21D 39/00

[52] U.S. Cl. ..... 29/523; 29/421 R; 29/727; 72/62; 60/589; 92/165 R

[58] Field of Search ..... 72/58, 61, 62; 29/421 R, 523, 516, 727, 157.4; 60/589, 593; 92/165 R

[56] References Cited

U.S. PATENT DOCUMENTS

| | | | |
|---|---|---|---|
| 2,638,748 | 5/1953 | Miller | 60/589 |
| 2,847,827 | 8/1958 | Johnson | 60/589 |
| 4,055,063 | 10/1977 | Krips et al. | 72/62 |
| 4,161,187 | 7/1979 | Bauer | 29/157.1 R |
| 4,211,151 | 7/1980 | Wallischeck | 92/165 R |

FOREIGN PATENT DOCUMENTS

| | | |
|---|---|---|
| 1939105 | 8/1969 | Fed. Rep. of Germany . |
| 2400148 | 1/1974 | Fed. Rep. of Germany . |
| 2616523 | 3/1977 | Fed. Rep. of Germany . |

OTHER PUBLICATIONS

Podhorsky and Krips, "Hydraulishes Aufweiten Von Rohren", 1/1979.

Maschinenbau, "Hydraulische Rohrbefestigung".

*Primary Examiner*—Daniel C. Crane

*Assistant Examiner*—David B. Jones

*Attorney, Agent, or Firm*—Karl F. Ross

[57] ABSTRACT

An apparatus for expanding tube ends in a tube sheet of a heat exchanger tube bundle comprises a mandrel which can be inserted into the tube end and an expansion pressure generator connected to said mandrel. A source of filling liquid is also connected to the mandrel to the expansion pressure generator which has a port for the filling liquid selectively blocked by the plunger of the expansion pressure generator so that problems with check valves for the filling can be obviated.

3 Claims, 2 Drawing Figures

APPARATUS FOR PRESSURE FITTING A TUBE IN A PLATE, E.G. A TUBE SHEET

CROSS REFERENCE TO RELATED APPLICATION

The present application is related to the concurrently filed copending application Ser. No. 349,258, now U.S. Pat. No. 4,420,867 issued Dec. 20, 1983.

FIELD OF THE INVENTION

My present invention relates to an apparatus for the pressure fitting of a tube in a plate, e.g. a tube sheet of a heat exchanger or the like.

More particularly, this invention relates to an apparatus for use with or including an expanding mandrel capable of generating a high liquid pressure sufficient to expand a tube end in a bore so that the tube end is anchored in a pressure tight press-fitted arrangement therein.

BACKGROUND OF THE INVENTION

In a tube-bundle and other structures wherein a multiplicity of tubes are anchored in a pressure tight manner in a plate, e.g. a tube sheet, the tube can have an end which is fitted into a respective bore of the tube sheet and which is expanded so that the engagement of the outer surface of the tube end and the inner surface of the sheet defining the bore are in a press-fitted, mechanically secure engagement preventing the leakage of fluids even under elevated pressures between these surfaces.

Tube bundles and tube sheets of this type can be widely used in tube-bundle heat exchangers, boilers, reactors, condensers, digestors and like equipment.

It is known to expand a tube end in a bore of a tube sheet by hydraulic pressure, i.e. by introducing a mandrel into the tube end so that the mandrel defines with this tube end a compartment into which a liquid can be fed, the liquid being pressurized to spread the tube end into engagement with the wall of the bore.

For this purpose, a device for hydraulically expanding a tube end can comprise the aforementioned mandrel and means for delivering the extraction fluid to the clearance between the mandrel and the tube end, and a high pressure source for pressurizing this liquid.

This source can include a piston or ram which is displaced by another fluid and, by its displacement, sharply increases the pressure of the expansion liquid. Reference may be had to various publications describing the hydraulic expansion of tubes, for example the German Patent Document De OS No. 19 39 105 and an article by M. Podhorsky and H. Krips entitled *Hydraulisches Aufweiten von Rohren* (Hydraulic Expansion of Tubes) in *VGB Kraftwerkstechnik*, No. 1, 1979, pp 81–87.

In these publications, it is described how the tube end can be fitted with play in a bore of a tube sheet, a pressurizing mandrel can be inserted into the tubed end, the clearance between the mandrel and the tube end sealed at two spaced-apart locations to define an expansion zone, and a liquid (pressurizing fluid) introduced into this clearance.

This fluid, upon pressurization, spreads the tube end radially. The pressure-tight attachment of tubes in tubed sheets or the like, for example for tube bundle sheets exchangers, is of considerable significance for the economic fabrication of such equipment in an efficient and reproducible manner.

For some decades, mechanical press fitting techniques have been used although problems have been encountered with such techniques because they have been comparatively expensive and did not always yield reproducible results. The problems with such mechanical techniques are described in the above-mentioned Podhorsky et al article which also discusses the ability of hydraulic expansion approaches to overcome the disadvantages of the earlier systems.

In the Podhorsky et al article and in German Patent Document DE-AS No. 26 16 523, the pressurizing liquid is water while the force-generating liquid is another hydraulic medium, e.g. oil which is supplied at high pressure by a pump.

Between the pressurizable liquid and this expansion-generating liquid, a piston or ram is provided so that an alternatively small cross section of the ram is applied to the liquid in the expansion zone while the oil of the pump applies its force to a relatively large cross section portion of the piston or ram so that the piston acts as a pressure multiplier.

The piston or ram can be considered to have two piston members as in a stepped piston, one of which receives the pressure of the oil while the other pressurizes the water.

One of the disadvantages of the earlier systems of this type (see especially the German Patent Document DE-AS No. 26 16 523) is that means was required to fill the clearance with the pressurizable liquid and that between this means and the expansion zone, an automatically operated check valve was required so that the pressurizable liquid could be supplied but loss of force upon hydraulic pressurization was avoided, and during the application of the high pressure displacement of the pressurizing liquid back to the latter means was precluded.

A check valve of this type had various problems associated with its use. For example, pressures as high as 4,00 bar were required to expand the tube ends. The volume of the pressurizing liquid under the expansion pressure is less than the volume of the expanded liquid by the compression volume. Upon expansion of the tube end, a displacement volume is created which tends to drop the expansion pressure. However, since the compression volume as a rule is larger than the displacement value, even when the applied pressure is reduced, in a passive state of the system, the residual pressure in the zone remains at a higher level and means must be provided to bleed off this pressure excess. Thus the use of the check valve means that the other devices must be provided to bleed off excess pressure.

Furthermore at the levels of expansion pressure used, e.g. about 4,000 bar, it is not possible to provide absolutely pressure-tight check valves. Furthermore, since the filling of the clearance is generally effected at elevated pressure levels, say 400 bar, rapid and complete closure of the check valve cannot be ensured and frequently the residual pressure in the clearance which can be 300 bar or greater may exceed the filling pressure and prevent reopening of the valve.

In conventional devices utilized heretofore manually operated valves were necessary to bleed off the residual pressure.

OBJECTS OF THE INVENTION

It is the principal object of the present invention to provide an improved apparatus for hydraulically expanding a tube end whereby the disadvantages of earlier systems are obviated.

Another object of this invention is to provide an apparatus for the purposes described which eliminates the need for a self-locking check valve of the type hitherto required in tube expansion systems.

Still another object of this invention is to provide an apparatus for the hydraulic expansion of a tube end, e.g. to pressure fit the tube end in a tube sheet, whereby problems with manually actuated residual-pressure bleeding valves are eliminated.

SUMMARY OF THE INVENTION

These objects and others are attained, in accordance with the invention, in an apparatus for the pressure fitting of a tube end in a bore of a tube sheet or the like by expanding the tube end with a pressure liquid, the apparatus comprising a mandrel which can be inserted into the tube end and sealed relative thereto so that an annular space is provided between this mandrel and the tube end, the mandrel having a passage opening into this space.

This passage communicates with a pressurizing cylinder in which a piston is axially displaceable under the force of a pressurizing fluid, e.g. liquid, such as a hydraulic medium displaced by a pump, a high pressure seal being provided for engagement with this piston so that, when it pressurizes the pressure liquid (e.g. water) at tube-expansion pressures, this liquid cannot leak back along the piston or ram.

According to the invention, the filling arrangement for the pressure liquid communicates with the mandrel passage at the pressure generator provided with the aforementioned ram so that the pressure generator has a filling connection which communicates with the cylinder rearwardly of this seal in the direction of displacement of the plunger to pressurize the tube end.

Since this connection is blocked by the plunger or ram itself, the connection is opened when the pressure generator is passive, i.e. when the ram is retracted, whereas the connection is blocked when the pressure generator is active, i.e. the ram has advanced to pressurize the liquid in the tube end.

In other words, the pressure generator is disposed between the filling device and the mandrel and the filled device is connected to the mandrel by the pressure generator, the mechanical blocking of the connection and unblocking of the connection between the liquid supply source and the mandrel passage replacing the automatically locking check valve hitherto deemed to be necessary.

In the passive condition of the pressure generator the liquid can be supplied from the source to the tube end via the mandrel passage and, upon activation of the pressure generator, the advance of the ram or plunger blocks this connection so that the liquid, even at the highest pressure, cannot flow back to the source. When the plunger is retracted into a passive state of the pressure generator, the connection between the mandrel and the filling port is again opened so that residual pressure can be dropped.

The plunger can be provided with a full pressure seal, i.e. adapted to be able to withstand the full pressure generated for expansion of the tube end so that, according to the invention, this seal surrounds the plunger between the filling port previously mentioned and the mandrel passage. This seal, of course, corresponds to the high pressure seal previously mentioned.

Another seal, hitherto referred to as a low pressure or filling pressure seal can also surround the plunger and can be dimensioned to withstand the filling pressure generated by the aforementioned source. In this case the connection with the source is located between these two seals.

According to another feature of the invention the plunger or piston is displaceable by the pressurizing fluid against a force-storing means, e.g. a spring which serves to return the piston or plunger to its passive position ensuring complete opening of the filling fitting. This prevents partial opening or partial blocking of this connection from limiting the venting of the mandrel passage.

According to another feature of the invention the high pressure seal is formed on the inner wall of the pressurizable cylinder, e.g. as a so-called pole seal, thereby eliminating problems of a type which have developed when the high pressure seal is mounted on the piston and drums, a so-called piston seal.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
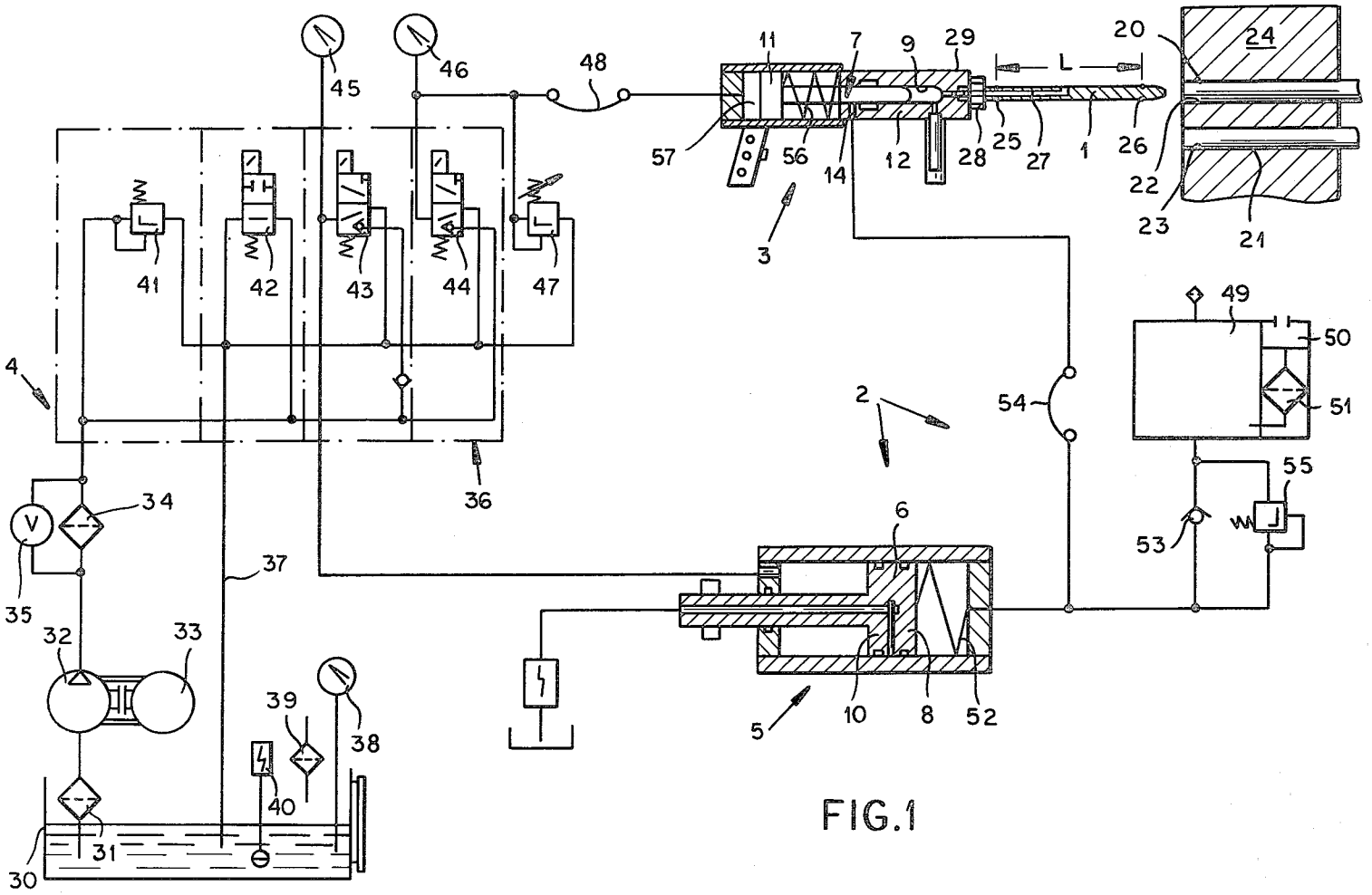
FIG. 1 is a flow diagram illustrating the apparatus of the present invention.

FIG. 1 shows an apparatus for the expansion of a tube end 20 or 21 previously inserted into a bore 22 or 23 in a tube sheet 24 of a tube-bundle sheet exchanger, as described, for example, in the aforementioned copending application.

The apparatus comprises an expansion mandrel 1 carrying a pair of seals 25, 26 adapted to engage the inner walls of the tubes 20 or 21 to define an expansion zone of a distance L to which a pressure fluid can be fed through a passage 27 formed in the mandrel which has been shown cross sectionally in FIG. 1. The mechanics of expanding the tube are explained in the aforementioned copending application. Suffice it to say that the pressure liquid can urge the seals into tight engagement with the tube whereupon the pressure generator delivers a high pressure of the order of 4,000 bar to this liquid and thereby spreads the tube, previously received with play in the plate 24, against the wall of its bore to secure the tube in a pressure-tight fashion thereof.

The mandrel 1 is secured by a nut 28 in the body 29 of a pressure generator 3.

The apparatus also comprises a source of pressurizing liquid, represented at 4 supplying the pressure generator and a source 2 of the pressure liquid, e.g. water, which is connected to the mandrel 1 by the pressure generator.

The pressurizing liquid can be oil drawn from a reservoir 30 via a filter 31 by a pump 32 driven by an electric motor 33 and supplied by a filter 34 which can be shunted by a valve 35 to a control valve system represented at 36.

Return from this valve system to the reservoir is effected via line 37.

A gauge 38 signals the level of liquid in the reservoir, a filter 39 represents a cleaning filter through which the oil is continuously circulated and an alarm device 40 constitutes a low-level working alarm.

Control valve arrangement 36 comprises a pressure limiting valve 41 preventing the development of excess pressure and shunting any such excess to the return line.

When fluid is not to be delivered to the pressure generator 3, a valve 42 can be opened effecting a direct shunt to the reservoir. Valves 43 and 44 deliver the filling pressure and the expansion pressure, respectively, each of these valves being equipped with a pressure gauge 45, 46. A further pressure relief valve 47 is effective to guarantee that excessive pressure surges are delivered to the return line 37. The valve system is connected by a flexible pipe 48 with the pressure generator 3.

The water reservoir is shown at 49 and can be filled via chamber 50 to the filter 51. When the piston 6 is retracted, e.g. by the spring 52, the water is drawn into the pump 5 via the check valve 53.

When the piston 6 is driven to the right, this water is forced through the flexible pipe 54 to the fitting or connection 14 as will be described below to fill the space between the mandrel and the tube end.

The filling pressure is limited by the pressure relief valve 55.

Thus the pressure fluid is water supplied from the reservoir 49 while the pressurizing fluid is oil delivered by the pump 32, the filling pressure generator 5 being equipped with stepped piston 6 while the expansion pressure generator 3 is equipped with a stepped piston 7.

The piston 8 thus displaces the water in the filling device while the plunger 9 displaces and pressurizes the water in the mandrel.

The expansion pressure generator 3 comprises a pressure cylinder 12 in which the stepped piston 7 with its pressurizing plunger 9 is axially displaceable, this piston being retracted by a spring 56.

Figure 2:
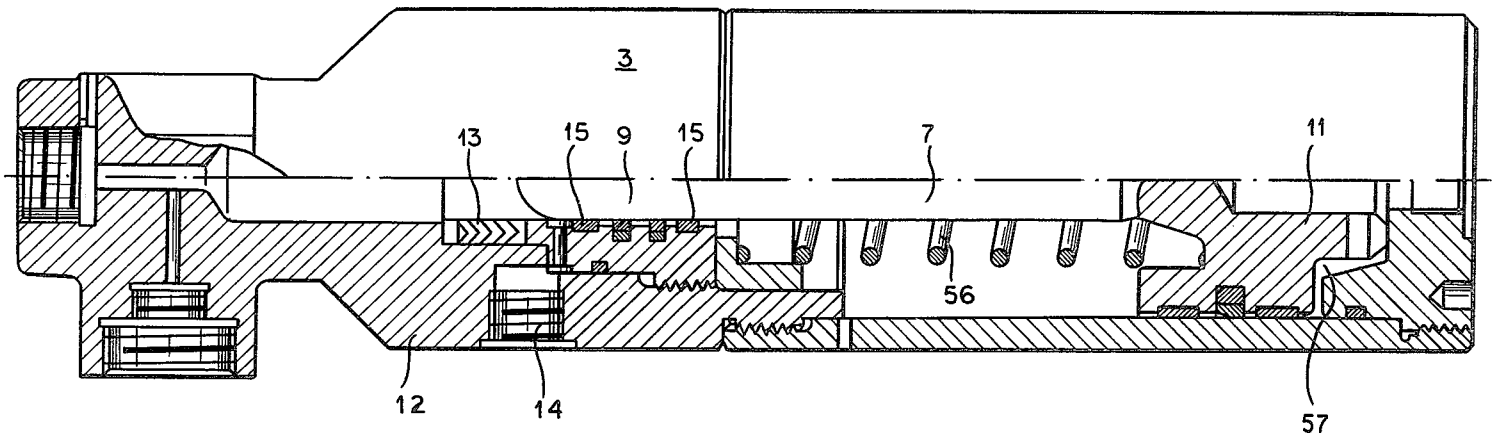
FIG. 2 is a partial section through the barrel of a pressure generator as utilized in the apparatus of FIG. 1.

As can be seen from FIG. 2, the expansion pressure (high pressure) seal 13 is provided between the large diameter step 11 of piston 7 and the mandrel. This seal engages a plunger and prevents back flow of the high pressure water during the expansion operation.

According to the invention the connection or fitting (port) 14 between the filling device 2 and the pressure generator 3 is disposed rearwardly of the seal 13 or, put differently, the seal 13 is disposed between the connection 14 and the mandrel. Thus, in a passive or retracted state of the plunger 9, communication is opened through the port 14 between the pump 5 and the passage 27 so that the pressure liquid can be delivered to the tube end.

As the plunger advances, however, it engages the seal 13 and blocks the port 14, thereby closing the connection between the filling device and the mandrel when the expansion pressure generator is active.

It has been found to be advantageous, moreover, to provide a filling pressure seal 15 which cooperates with the plunger 9 such that the port 14 communicates with the mandrel between the seals 13 and 15. A spring 56 retracts the piston 7 and the plunger 9 when oil pressure is not delivered to the compartment 57.

I claim:

1. An apparatus for expanding a tube and received in a plate such as a tube sheet, said apparatus comprising:

an expansion mandrel receivable in and sealed against said tube end and being provided with a passage for delivering a filling pressure liquid to said tube end to expand the same and pressure fit the tube in said plate;

an expansion pressure generator comprising a body forming a cylinder, a stepped piston received in said cylinder and having a small cross section step forming a plunger for pressurizing said filler pressure liquid, and a large cross section step pressurizable by an expansion pressure liquid, and means for delivering said expansion pressure liquid under pressure to said cylinder to displace said piston and generate an expansion pressure in said filling pressure liquid; and a source of said filling pressure liquid and means including a port in said body communicating with said passage for supplying said filling pressure liquid to said passage while said piston is in a retracted position, said piston blocking said port and the flow of said filling pressure liquid when in an advanced position of said plunger, said expansion pressure generator including an expansion pressure seal recessed in a wall of said cylinder, said port being disposed upstream of said seal in an advancing direction of displacement of said piston and said seal cooperating with said plunger only in said advanced position to pressurize said filling pressure liquid.

2. The apparatus defined in claim 1 further comprising a filling pressure seal in said body surrounding said plunger and located upstream of said port.

3. The apparatus defined in claim 1, or claim 2, further comprising a spring acting upon said piston for displacing same into said retracted position.

* * * * *